US007459033B2

(12) United States Patent
Asahi et al.

(10) Patent No.: US 7,459,033 B2
(45) Date of Patent: Dec. 2, 2008

(54) OIL COUNTRY TUBULAR GOODS EXCELLENT IN COLLAPSE CHARACTERISTICS AFTER EXPANSION AND METHOD OF PRODUCTION THEREOF

(75) Inventors: Hitoshi Asahi, Futtsu (JP); Eiji Tsuru, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 422 days.

(21) Appl. No.: 10/518,663

(22) PCT Filed: Jun. 12, 2003

(86) PCT No.: PCT/JP03/07503

§ 371 (c)(1),
(2), (4) Date: Dec. 17, 2004

(87) PCT Pub. No.: WO04/001076

PCT Pub. Date: Dec. 31, 2003

(65) Prior Publication Data

US 2005/0217768 A1 Oct. 6, 2005

(30) Foreign Application Priority Data

Jun. 19, 2002 (JP) ..... 2002-178770
May 8, 2003 (JP) ..... 2003-130472

(51) Int. Cl.
*C22C 38/12* (2006.01)
*C22C 38/14* (2006.01)

(52) U.S. Cl. ..... 148/320; 148/330; 148/331; 148/332; 148/333; 148/334; 148/335; 148/909

(58) Field of Classification Search ..... 148/320, 148/330–336, 593, 602, 902, 909, 519–521; 420/126–128

See application file for complete search history.

(56) References Cited

U.S. PATENT DOCUMENTS

| | | | | |
|---|---|---|---|---|
| 4,772,771 | A | 9/1988 | Murayama et al. | |
| 6,245,290 | B1 * | 6/2001 | Koo et al. | 420/119 |
| 7,225,868 | B2 * | 6/2007 | Arai et al. | 166/277 |

FOREIGN PATENT DOCUMENTS

| | | | |
|---|---|---|---|
| GB | 2155950 | A | 10/1985 |
| JP | 61-279623 | A | 12/1986 |
| JP | 64-25916 | A | 1/1989 |
| JP | 01025916 | | 1/1989 |
| JP | 06-184693 | * | 7/1994 |
| JP | 2002-129283 | A | 5/2002 |
| JP | 2002129283 | | 5/2002 |

* cited by examiner

*Primary Examiner*—Deborah Yee
(74) *Attorney, Agent, or Firm*—Kenyon & Kenyon LLP

(57) ABSTRACT

The present invention provides a method of production of oil country tubular goods having a small drop in collapse pressure after expansion and having a collapse pressure recovering by low temperature ageing at about 100° C. and oil country tubular goods obtained by this method of production.

This method of production comprises hot rolling a steel slab having amounts of addition of C, Mn, P, S, Nb, Ti, Al, and N in specific ranges and having a balance of iron and unavoidable impurities and shaping the steel strip coiled at a temperature of not more than 300° C. as it is into a tube. Alternatively, it comprises heating steel pipe having amounts of addition of C, Mn, P, S, Nb, Ti, Al, and N in specific ranges and having a balance of iron and unavoidable impurities to a temperature of the $Ac_3$ [° C.] to 1150° C., then cooling it in a range of 400 to 800° C. at a rate of 5 to 50° C./second.

6 Claims, No Drawings

OIL COUNTRY TUBULAR GOODS EXCELLENT IN COLLAPSE CHARACTERISTICS AFTER EXPANSION AND METHOD OF PRODUCTION THEREOF

TECHNICAL FIELD

The present invention relates to oil country tubular goods suitable as steel pipe used in oil wells for expandable tubular technology creating oil wells or gas wells by expanding oil country tubular goods, featuring little drop in collapse characteristics after expansion, and improved in collapse characteristics by low temperature ageing at about 100° C. after expansion.

BACKGROUND ART

In the past, oil country tubular goods had been inserted into the wells and used as is, but in recent years technology has been developed for use after expansion 10 to 20% in the wells. This has greatly contributed to the reduction of oil well and gas well development costs. However, if tensile plastic strain is introduced in the circumferential direction due to the expansion, the yield strength with respect to the compressive stress in the circumferential direction due to outside pressure (hereinafter referred to as the "compression yield strength") will drop and the pressure at which the steel pipe collapses due to outside pressure (hereinafter referred to as the "collapse pressure") will drop. This, as is well known as the Bauschinger effect, is the phenomenon where, after plastic deformation, if applying stress in the opposite direction to the direction in which plastic strain was applied, yield occurs by a stress lower than before plastic deformation.

The Bauschinger effect occurs due to plastic stress, so a method for restoring the reduced compression yield strength by heat treatment has been disclosed in Japanese Unexamined Patent Publication (Kokai) No. 9-3545 and Japanese Unexamined Patent Publication (Kokai) No. 9-49025 and reported in numerous research papers. However, if expanding pipe in a well, later high temperature heat treatment is not possible in the well, so steel pipe with little drop in collapse strength after expansion has been sought.

DISCLOSURE OF INVENTION

The present invention provides oil country tubular goods excellent in collapse characteristics with a small rate of drop of collapse pressure due to the Bauschinger effect after expansion in an oil well pipe and further oil country tubular goods excellent in collapse characteristics improved in collapse pressure due to low temperature ageing at near about 100° C. able to be performed in an oil well and methods for the production of the same.

The inventors engaged in detailed studies on steel pipe exhibiting the Bauschinger effect and its recovery behavior and methods of production of the same, in particular ageing and other heat treatment and hot rolling conditions having an effect on the properties of steel pipe. As a result, they discovered that steel having a structure including a low temperature transformation phase obtained by hot rolling, cooling, then coiling at a low temperature of not more than 300° C. has a smaller rate of drop of the compression yield strength due to the Bauschinger effect compared with steel coiled at 500 to 700° C., quenched, and tempered and further is restored in the compression yield strength by ageing near about 100° C. Further, they discovered that when bending and welding such produced steel strip to make steel pipe, low temperature ageing after expansion enables steel pipe excellent in collapse strength to be obtained. Further, they discovered that regardless of the coiling temperature after hot rolling, if rapidly cooling the steel from the austenite region, a microstructure comprised of one or both of bainitic fertite and bainite containing C or other elements in supersaturated solid solution is obtained, the rate of drop in the compression yield strength is small, and the compression yield strength is restored by ageing.

The present invention was made after repeated experiments based on these discoveries and has as its gist the following:

(1) Oil country tubular goods excellent in collapse characteristics after expansion containing, by wt %:

C: 0.03 to 0.3%,
Si: 0.8% or less,
Mn: 0.3 to 2.5%,
P: 0.03% or less,
S: 0.01% or less,
Nb: 0.01 to 0.3%,
Ti: 0.005 to 0.03%,
Al: 0.1% or less, and
N: 0.001 to 0.01% and comprising a balance of Fe and unavoidable impurities, characterized in that a ratio of collapse pressure after expansion and collapse pressure before expansion is in the range of a/b: 0.85 to less than 1.0, where a: collapse strength (MPa) after expansion 10 to 20% and b: collapse strength (MPa) of unexpanded steel pipe of same dimensions as steel pipe measured for a.

(2) Oil country tubular goods excellent in collapse characteristics after expansion containing, by wt %:

C: 0.03 to 0.3%,
Si: 0.8% or less,
Mn: 0.3 to 2.5%,
P: 0.03% or less,
S: 0.01% or less,
Nb: 0.01 to 0.3%,
Ti: 0.005 to 0.03%,
Al: 0.1% or less, and
N: 0.001 to 0.01%,
further containing one or more of:
Ni: 1% or less,
Mo: 0.6% or less,
Cr: 1% or less,
Cu: 1% or less,
V: 0.3% or less,
B: 0.0003 to 0.003%,
Ca: 0.01% or less, and
REM: 0.02% or less, and comprising a balance of Fe and unavoidable impurities, characterized in that a ratio of collapse pressure after expansion and collapse pressure before expansion is in the range of a/b: 0.85 to less than 1.0, where a: collapse strength (MPa) after expansion 10 to 20% and b: collapse strength (MPa) of unexpanded steel pipe of same dimensions as steel pipe measured for a.

(3) Oil country tubular goods excellent in collapse characteristics after expansion containing, by wt %:

C: 0.03 to 0.3%,
Si: 0.8% or less,
Mn: 0.3 to 2.5%,
P: 0.03% or less,
S: 0.01% or less,
Nb: 0.01 to 0.3%,
Ti: 0.005 to 0.03%,
Al: 0.1% or less, and
N: 0.001 to 0.01% and comprising a balance of Fe and unavoidable impurities, characterized in that a ratio c/d of collapse pressure after expansion and ageing and collapse pressure before expansion is in the range of 1 to 1.2, where c: collapse strength (MPa) after expansion 10 to 20% and ageing at 80 to 200° C. and d: collapse strength (MPa) of unexpanded steel pipe of same dimensions as steel pipe measured for a.

(4) Oil country tubular goods excellent in collapse characteristics after expansion containing, by wt %:

C: 0.03 to 0.3%,
Si: 0.8% or less,
Mn: 0.3 to 2.5%,
P: 0.03% or less,
S: 0.01% or less,
Nb: 0.01 to 0.3%,
Ti: 0.005 to 0.03%,
Al: 0.1% or less, and
N: 0.001 to 0.01%,
further containing one or more of:
Ni: 1% or less,
Mo: 0.6% or less,
Cr: 1% or less,
Cu: 1% or less,
V: 0.3% or less,
B: 0.0003 to 0.003%,
Ca: 0.01% or less, and
REM: 0.02% or less, and comprising a balance of Fe and unavoidable impurities, characterized in that a ratio c/d of collapse pressure after expansion and ageing and collapse pressure before expansion is in the range of 1 to 1.2, where c: collapse strength (MPa) after expansion 10 to 20% and ageing at 80 to 200° C. and d: collapse strength (MPa) of unexpanded steel pipe of same dimensions as steel pipe measured for a.

(5) Oil country tubular goods excellent in collapse characteristics after expansion as set forth in any one of (1) to (4) characterized in that said oil country tubular goods has a hot rolled structure comprised of a low temperature transformation phase of bainitic ferrite or bainite alone or combined.

(6) Oil country tubular goods excellent in collapse characteristics after expansion as set forth in any one of (1) to (6) characterized in that a welded part is normalized or quenched and tempered.

(7) Oil country tubular goods excellent in collapse characteristics after expansion as set forth in any one of (1) to (5) characterized by being used expanded in an oil well drilled into the ground.

(8) Oil country tubular goods excellent in collapse characteristics after expansion as set forth in any one of (1) to (5) characterized in that a welded part is normalized or quenched and tempered and by being used expanded in an oil well drilled into the ground.

(9) Oil country tubular goods excellent in collapse characteristics after expansion as set forth in any one of (1) to (5) characterized by being used expanded in an oil well drilled into the ground and with a fluid of 80 to 200° C. circulated through the well after expansion.

(10) Oil country tubular goods excellent in collapse characteristics after expansion as set forth in any one of (1) to (5) characterized in that a welded part is normalized or quenched and tempered and by being used expanded in an oil well drilled into the ground and with a fluid of 80 to 200° C. circulated through the well after expansion.

(11) A method of production of oil country tubular goods excellent in collapse characteristics after expansion characterized by hot rolling a slab containing, by wt %:

C: 0.03 to 0.3%,
Si: 0.8% or less,
Mn: 0.3 to 2.5%,
P: 0.03% or less,
S: 0.01% or less,
Nb: 0.01 to 0.3%,
Ti: 0.005 to 0.03%,
Al: 0.1% or less, and
N: 0.001 to 0.01% and comprising a balance of Fe and unavoidable impurities, coiling the strip at not more than 300° C., shaping the hot rolled steel strip into a tube as it is, then welding the seam.

(12) A method of production of oil country tubular goods excellent in collapse characteristics after expansion characterized by hot rolling a slab containing, by wt %:

C: 0.03 to 0.3%,
Si: 0.8% or less,
Mn: 0.3 to 2.5%,
P: 0.03% or less,
S: 0.01% or less,
Nb: 0.01 to 0.3%,
Ti: 0.005 to 0.03%,
Al: 0.1% or less, and
N: 0.001 to 0.01%,
further containing one or more of:
Ni: 1% or less,
Mo: 0.6% or less,
Cr: 1% or less,
Cu: 1% or less,
V: 0.3% or less,
B: 0.0003 to 0.003%,
Ca: 0.01% or less, and
REM: 0.02% or less, and comprising a balance of Fe and unavoidable impurities, coiling the strip at not more than 300° C., shaping the hot rolled steel strip into a tube as it is, then welding the seam.

(13) A method of production of oil country tubular goods excellent in collapse characteristics after expansion as set forth in (11) or (12) characterized in that said oil country tubular goods has a hot rolled structure comprised of a low temperature transformation phase of bainitic ferrite or bainite alone or combined.

(14) A method of production of oil country tubular goods excellent in collapse characteristics after expansion characterized by heating steel pipe comprised of the ingredients and structure set forth in any one of (11) to (13) to a temperature of the $Ac_3$ point (° C.) to 1150° C., then cooling it in a range of 400 to 800° C. at 5 to 50° C./sec.

(15) A method of production of oil country tubular goods excellent in collapse characteristics after expansion as set forth in any one of (11) to (13) characterized by expanding the pipe by extracting a plug of a diameter larger than the inside diameter of the steel pipe.

(16) A method of production of oil country tubular goods excellent in collapse characteristics after expansion characterized by heating steel pipe comprised of the ingredients and structure set forth in any one of (11) to (13) to a temperature of the $Ac_3$ point (° C.) to 1150° C., then cooling it in a range of 400 to 800° C. at 5 to 50° C./sec and expanding the pipe by extracting a plug of a diameter larger than the inside diameter of the steel pipe.

BEST MODE FOR CARRYING OUT THE INVENTION

The inventors engaged in detailed studies on the effects on the Bauschinger effect and its recovery behavior by the methods of production, structures, and chemical compositions of steels and the solid solution state of the added elements and in particular took note of the coiling temperature after hot rolling and cooling. They heated steel slabs of various chemical compositions to the austenite region, subjected them to rough rolling and finishing rolling, then cooled the strips and coiled them in the temperature range of 300 to 700° C. After this, they made pipes and studied in detail the effects of the coiling temperature on the collapse pressure due to the Bauschinger effect after expansion and evaluated the same by the ratio between the collapse pressure of the steel pipe after expansion and the collapse pressure of the steel pipe before expansion. Note that the collapse pressure is affected by the dimensions of the steel pipe, so the collapse pressure of the steel pipe before expansion was measured as the collapse pressure of steel pipe of the same dimensions as after expansion but unexpanded.

As a result, it was learned that steel produced by hot rolling, then coiling in the temperature range of 500 to 700° C. ended up dropping about 30% from the collapse pressure before expansion due to the Bauschinger effect after expansion. Further, the collapse pressure dropping due to expansion did not improve by low temperature ageing at about 100° C., but recovered to the same level as the collapse pressure before expansion if heat treatment was performed at a temperature of 300° C. or more.

As opposed to this, they learned that the drop in collapse pressure of steel having a coiling temperature of 300° C. or less was at most 15% from the collapse pressure before expansion. Further, the compression yield strength which dropped due to the Bauschinger effect rose due to low temperature ageing at about 100° C., reached the collapse value before expansion or more, and became a collapse pressure 20% higher than the unexpanded pipe in some cases. This extent of low temperature ageing can be performed utilizing the natural temperature in an oil well and is easily realized artificially as well. Therefore, recovery of the compression yield strength by low temperature ageing of about 100° C. is particularly important for raising the collapse pressure of steel pipe expanded in an oil well.

The inventors investigated the microstructure of steels coiled at 300° C. or less and as a result learned that they have structures including low temperature transformation phases such as upper bainite. Such low temperature transformation phases are believed to suppress the drop in compression yield strength due to the Bauschinger effect. Further, the reasons why the compression yield strength after expansion rose to equal or more than the compression yield strength before expansion by the low temperature ageing at about 100° C. are considered to be the easy change of stress locations around dislocation causing the Bauschinger effect and the fixing at dislocation of C and other elements present in the solid solution state. Therefore, it is extremely important not to perform any heat treatment after coiling hot rolled steel strip, but to form pipe as is to produce steel pipe.

In this way, steel pipe may be produced in principle by seamless rolling as well, but with seamless steel pipe, large working at a temperature corresponding to the finishing rolling is not possible. Therefore, as-rolled seamless steel pipe has the defects of a large crystal grain size and a low yield strength of the material, so a low collapse pressure and further large unevenness of thickness, so susceptibility to bending during expansion.

Next, steel pipes produced under usual conditions of the coiling temperature after hot rolling and cooling were heated to the austenite region, rapidly cooled, quenched, tempered, and otherwise heat treated, then measured for collapse pressure after expansion. As a result, the inventors learned that steels with microstructures of tempered martensite or tempered bainite structures obtained by quenching and tempering ended up dropping as much as about 30% from the collapse pressure before expansion due to the Bauschinger effect after expansion. Further, the collapse pressure dropping due to expansion did not improve by low temperature ageing at about 100° C., but recovered to the same level as the collapse pressure before expansion upon heat treatment at a temperature of 300° C. or more.

As opposed to this, they learned that the drop in the collapse pressure of steels obtained by heating to the austenite region, then rapidly cooling and in that state given microstructures of one or both of bainitic ferrite and bainite was about most 15% from the collapse pressure before expansion. Further, the compression yield strength which dropped due to the Bauschinger effect rose due to low temperature ageing at about 100° C., reached the collapse value before expansion or more, and became a collapse pressure 20% higher than the unexpanded pipe in some cases.

Such a low temperature transformation phase of one or both of bainitic ferrite and bainite, like a structure including a low temperature transformation phase such as upper bainite, is considered to suppress the drop in the compression yield strength due to the Bauschinger effect. Further, the reasons why the compression yield strength after expansion recovers due to low temperature ageing at about 100° C. are similar to those of steel coiled at 300° C. or less after hot rolling and cooling. It is extremely important not to temper the steel after rapid cooling from the austenite region. The method of production of such steel pipe does not have to be particularly defined. It may be used for both seamless steel pipe and welded steel pipe.

Next, the reasons for limitation of the chemical ingredients included in the oil country tubular goods according to the present invention will be explained. Basically, the chemical ingredients are limited to ranges giving high strength steel strip of a thickness of 7 mm to 20 mm with a strength of 550 MPa to 900 MPa required for oil country tubular goods under the above production conditions and having excellent toughness, in particular a small drop in low temperature toughness due to expansion and ageing.

C is an element essential for enhancing the hardenability and improving the strength of the steel. The lower limit required to obtain the target strength is 0.03%. However, if the amount of C is too great, with the process of the present invention, the strength becomes too high and a remarkable deterioration in the low temperature toughness is invited, so the upper limit was made 0.30%.

Si is an element added for deoxygenation or improvement of strength, but if added in an amount greater than this, the low temperature toughness is remarkably deteriorated, so the upper limit was made 0.8%. Deoxygenation of steel is also sufficiently possible by Al and Ti as well. Si does not necessarily have to be added. Therefore, no lower limit is defined, but usually this is included in an amount of 0.1% or more as an impurity.

Mn is an element essential for enhancing the hardenability and securing a high strength. The lower limit is 0.3%. However, if the amount of Mn is too great, martensite is produced in a large amount and the strength becomes too high, so the upper limit was made 2.5%.

Further, the steel of the present invention contains as essential elements Nb and Ti.

Nb not only suppresses recrystallization of austenite to make the structure finer at the time of rolling, but also contributes to an increase of the hardenability and toughens the steel. Further, it contributes to the recovery from the Bauschinger effect by the ageing. The effect is small if the amount of Nb added is less than 0.01%, so this is made the lower limit. However, if greater than 0.3%, the low temperature toughness is adversely affected, so the upper limit was made 0.3%.

Ti forms fine TiN and suppresses the coarsening of the austenite grains at the time of slab reheating to make the microstructure finer and improve the low temperature toughness. Further, if the amount of Ai is a low one of for example not more than 0.005%, Ti forms oxides and therefore has a deoxygenation effect as well. To manifest this effect of TiN, a minimum of 0.005% of Ti has to be added. However, if the amount of Ti is too great, coarsening of TiN or precipitation hardening due to TiC occur and the low temperature toughness is degraded, so the upper limit was limited to 0.03%.

Al is an element usually included in steel as a deoxygenating material and has the effect of making the structure finer as well. However, if the amount of Al is over 0.1%, the Al-based nonmetallic inclusions increase and detract from the cleanliness of the steel, so the upper limit was made 0.1%. However, deoxygenation is also possible with Ti and Si, so Al does not necessarily have to be added. Therefore, no lower limit is limited, but usually 0.001% or more is included as an impurity.

N forms TiN, suppresses the coarsening of the austenite grains at the time of slab reheating, and improves the low temperature toughness of the base material. The minimum amount required for this is 0.001%. However, if the amount of N becomes too great, the TiN is coarsened and surface defects, deteriorated toughness, and other problems occur, so the upper limit has to be suppressed to 0.01%.

Further, in the present invention, the amounts of the impurity elements P and S are made 0.03% and 0.01% or less. The main reason is to further improve the low temperature toughness of the base material and improve the toughness of the weld. Reduction of the amount of P mitigates the center segregation of the continuously cast slab and prevents grain destruction to improve the low temperature toughness. Further, reduction of the amount of S reduces the MnS drawn by hot rolling and improves the drawing toughness in effect. With both P and S, the less the better, but this has to be determined by the balance of characteristics and cost. Normally P and S are contained in amounts of 0.01% or more and 0.003% or more.

Next, the objects of adding the optional elements Ni, Mo, Cr, Cu, V, Ca, and REM will be explained. The main object of adding these elements is to try to further improve the strength and toughness and increase the size of the steel material which can be produced without detracting from the excellent features of the steel of the present invention.

The object of adding Ni is to suppress deterioration of the low temperature toughness. Addition of Ni, compared with addition of Mn or Cr and Mo, seldom forms a hard structure harmful to low temperature toughness in a rolled structure, in particular the center segregation zone of a continuously cast slab. However, if the amount of Ni is less than 0.1%, this effect is not sufficient, so addition of 0.1% or more is desirable. On the other hand, if the amount added is too great, martensite is produced in large amounts and the strength becomes too high, so the upper limit was made 1.0%.

Mo is added to improve the hardenability of steel and obtain a high strength. Further, it also acts to promote recovery from the Bauschinger effect by the low temperature ageing at 100° C. or so. Further, Mo is also effective in suppressing recrystallization of austenite at the time of controlled rolling together with Nb and in making the austenite structure finer. To express this effect, Mo is preferably added in an amount of 0.05% or more. On the other hand, excessive addition of Mo results in martensite being produced in large amounts and the strength becoming to high, so the upper limit was made 0.6%.

Cr increases the strength of the base material and welded part. To achieve this effect, Cr is preferably added in an amount of 0.1% or more. On the other hand, if the amount of Cr is too great, martensite is produced in large amounts and the strength becomes to high, so the upper limit was made 1.0%.

V has substantially the same effect as Nb, but the effect is weak relative to Nb. To make it sufficiently manifest this effect, it is preferable that it be added in an amount of at least 0.01%. On the other hand, if the amount added is too great, the low temperature toughness is degraded, so the upper limit was made 0.3%.

Ca and REM control the form of the sulfides (MnS etc.) and improve the low temperature toughness. To obtain these effects, it is preferable to add Ca in an amount of 0.001% or more and REM in an amount of 0.002% or more. On the other hand, if the adding Ca in an amount more than 0.01% and REM more than 0.02%, a large amount of CaO-CaS or REM-CaS is produced resulting in large sized clusters and large sized inclusions and impairs the cleanliness of the steel. Therefore, the upper limit of the amount of addition of Ca was limited to 0.01% and the upper limit of the amount of addition of REM was limited to 0.02%. Note that a preferable upper limit of the amount of addition of Ca is 0.006%.

Next, the production conditions for oil country tubular goods containing the above ingredients will be explained.

The present invention limits the coiling temperature after hot rolling and cooling to not more than 300° C. This is the most fundamental point of the aspects of the invention of (11) to (13) and is an essential condition for forming an upper bainite or other low temperature transformation structure and causing residual elements in solid solution. Due to this, steel pipe is obtained which is excellent in strength and toughness, features little drop in collapse pressure after expansion, and further is improved in collapse pressure due to ageing.

If the coiling temperature becomes higher than 300° C., the structure becomes mainly ferrite, precipitation occurs, and the desired effect can no longer be obtained. That is, the drop in collapse pressure due to the Bauschinger effect after expansion becomes great and the dropped collapse pressure can no longer be improved by low temperature ageing. On the other hand, the lower limit of the coiling temperature is not particularly limited in terms of characteristics, but sometimes is limited by the coiling capacity of the production facility. At the current level of technology, a range of 50 to 150° C. is the lower limit possible with normal production.

Steel pipe obtained by shaping hot rolled steel strip produced by coiling at not more than 300° C. into a tube as is and then welding the seam in this way has a small drop in the collapse pressure after expansion. The ratio a/b of the collapse pressure a of the steel pipe after expansion 10 to 20% and the collapse pressure b of steel pipe of the same composition and dimensions as a but unexpanded is 0.85 to less than 1.

Note that in general the welded part and heat affected zone become lower in low temperature toughness, so when necessary it is possible to heat the welded part to the austenite region and allow it to cool (normalization) or quench and temper it. The heating temperature of the normalization and quenching is preferably 900 to 1000° C. If under 900° C., the austenitization is sometimes insufficient, while if over 1000° C., the crystal grains become coarser. The tempering is preferably performed at 500 to 700° C. If under 500° C., the tempering effect is not sufficient, while if over 700° C., transformation to austenite occurs. Normally, this treatment is performed by an induction heating apparatus after making the pipe, so the holding time is about several tens of seconds.

The method of shaping the steel pipe may be a generally used method of shaping steel pipe such as press forming or roll forming. Further, the method of welding the seam used may be laser welding, arc welding, or electric resistance welding, but an electric resistance welding process is high in productivity and gives a small welding heat affected zone, so is suited to production of the oil country tubular goods of the present invention.

The aspects of the invention of (14) and (16) heat the steel pipe produced under ordinary conditions to the austenite region and then rapidly cool it. This steel pipe may be welded steel pipe or seamless steel pipe. This is to make the microstructure of the steel pipe one or both of bainitic ferrite and bainite and to make C or other elements be dissolved there in supersaturated solid solution. Due to this, steel pipe is obtained which is excellent in strength and toughness, has a low drop in collapse pressure after expansion, and is improved in collapse pressure by ageing.

With a heating temperature of under the $Ac_3$ point [° C.], ferrite remains and a high yield strength cannot be obtained. The $Ac_3$ point [° C.] may be calculated from the amounts of ingredients or may be found experimentally by the change in the linear heat expansion coefficient at the time of heating. Further, if heating to a high temperature over 1150° C., the coarsening of the crystal grains becomes remarkable, the low temperature toughness drops conspicuously, and a microstructure comprised of one or both of bainitic ferrite and bainite becomes difficult to obtain.

As the formula for calculation of the $Ac_3$ point (° C.) at the time of calculation from the amounts of ingredients, for example the following formula may be used:

$$Ac_3=910-203\,[\%\,C]+44.7\,[\%\,Si]-30\,[\%\,Mn]$$

where, [% C], [% Si], and [% Mn] are the contents of C, Si, and Mn expressed by wt % and made dimensionless. The coefficients of C, Si, and Mn show the effects of 1 wt % of the elements on the $Ac_3$ point. The unit of the calculation formula is [° C.].

To obtain a homogeneous microstructure comprised of one or both of bainitic ferrite and bainite, the austenite grains before cooling are preferably fine grains. Note that a "microstructure comprised of one or both of bainitic ferrite and bainite" means, when observing the structure by an optical microscope, a ratio of area of the bainitic ferrite or bainite or mixed structure of bainitic ferrite and bainite of 100%.

The cooling after heating is performed by water cooling or mist cooling. The cooling rate is made a range of 5 to 50° C./second. The cooling rate may be found by attaching a thermocouple to the center of thickness of the steel pipe, finding the change of temperature over time, and dividing the temperature difference from 800° C. to 400° C., that is, 400° C., by the time required for cooling. It is also possible to change the thickness, outside diameter, and cooling conditions of the steel pipe in advance, find the curve of temperature-time at the time of cooling, and estimate the cooling rate from the thickness, outside diameter, and cooling conditions. It is also possible to determine the parameters of the heat conduction formula from the temperature-time curve at the time of cooling and find the rate by calculation.

This is extremely important for making the microstructure of the steel pipe one comprised of one or both of bainitic ferrite and bainite having C in supersaturated solid solution. In particular, it is necessary to control the cooling rate of the range of 400 to 800° C. If the cooling rate is less than 5° C./second, the amount of C in solid solution decreases, while if the cooling rate is over 50° C./second, martensite is produced, the strength rises and the toughness falls. Further, depending on the composition, martensite will easily be produced, so the preferable upper limit of the cooling rate is 30° C./second. Note that the preferable cooling rate changes depending on the composition, so it is preferable to conduct preliminary tests for confirming the change in the structure of the steel due to the cooling rate in advance and find the optimal cooling rate.

Further, the temperature for stopping the cooling should be under 400° C. After this, the steel should be allowed to naturally cool. Note that the cooling stopping temperature is preferably made less than 300° C. The steel should be cooled down to room temperature. If cooling to 400° C., with the steel of the present invention, the transformation will substantially completely end and the structure will be set. Further, to suppress precipitation during subsequent cooling and prevent a reduction of the amount of C in solid solution, it is preferable to cool down to under 300° C.

Steel pipe produced under ordinary conditions with a heating temperature from the $Ac_3$ point [° C.] to 1150° C. and a cooling rate of 5 to 50° C./second has a low drop in collapse pressure after expansion and has a ratio a/b of the collapse pressure a of the steel pipe after expansion 10 to 20% and the collapse pressure b of the steel pipe of the same composition and dimensions as a but unexpanded satisfying 0.85 to less than 1.

Further, if ageing after expansion, the collapse pressure recovers to an equal or higher level than before expansion. The ratio c/d of the collapse pressure c of the steel pipe aged at 80 to 200° C. after expansion 10 to 20% and the collapse pressure d of the steel pipe of the same composition and dimensions as c but not expanded becomes a range of 1 to 1.2. The ageing temperature range was made 80 to 200° C. because this is the temperature range enabling natural ageing in an oil well. The ageing is sufficiently effective at a temperature of about 100° C. The low temperature toughness after ageing falls somewhat along with a rise in temperature. Therefore, the temperature range of the ageing is preferably 80 to less than 150° C. Further, the holding time has to be about 30 minutes to raise the collapse pressure. The effect of raising the collapse pressure by low temperature ageing becomes saturated by holding for 24 hours, but when using the natural temperature in a well, a time of longer than 24 hours does not pose any particular problem. Long time treatment is not excluded.

The thus produced oil country tubular goods is expanded to the targeted expansion rate of 10 to 20% or so. Note that the "expansion rate" is the rate of change of the outside diameter of the steel pipe from before to after expansion. This expansion may be performed by inserting a plug having a diameter larger than the inside diameter of the steel pipe and corresponding to the inside diameter after expansion and extracting the plug through the inserted oil country tubular goods from the bottom to the top by the drive power of water pressure from below the plug or a wire pulling it upward.

Such expansion can be performed by inserting the pipe into a well in the ground drilled by a drill pipe or a well in which another oil well pipe has already been placed. Wells sometime reach depths of several thousands of meters. In general, the deeper in the ground, the higher the temperature. Temperatures are frequently over 100° C. In such a case, the steel pipe of the present invention is aged at a low temperature after expansion and improved in collapse pressure compared with before expansion.

Further, at shallow parts of the ground, the temperature is sometimes lower than 80° C. At such a time, it is possible to greatly improve the collapse pressure by low temperature ageing artificially raising the temperature to 80 to 200° C. and holding the temperature there for 30 minutes to 24 hours. Note that the low temperature ageing is effective at about 100° C. The low temperature toughness falls somewhat along with a rise in temperature. Further, if considering economy, the range of the ageing temperature is preferably 80 to less than 150° C. Further, the holding time has to be about 30 minutes to improve the collapse pressure. Further, at 24 hours, the effect becomes saturated, but there is no particular problem even if holding for more than this time. This low temperature ageing for example suppresses collapse when drilling a well. Since a fluid (mud) is filled in the well for the purpose of recovering scraps, it is possible to heat this mud to 80 to 200° C. and circulate it for the ageing.

EXAMPLES

Example 1

Steels having the chemical compositions shown in Table 1 were produced by a converter and continuously cast to steel slabs which were then hot rolled by a continuous hot rolling machine to hot rolled steel strips of 12.7 mm thickness. The hot rolling was ended at 950° C., then the strips were cooled by the cooling rates shown in Table 2 and coiled. The hot rolled steel strips were used to produce steel pipes of outside diameters of 193.7 mm by the electric resistance welding process. Some of the pipes were quenched and tempered or normalized at the welded parts by a high frequency power source arranged on the production line. The quenching and tempering were performed by heating at 960° C. for 60 seconds, then water cooling from the outside surface, then heating at 680° C. for 60 seconds and allowing the result to cool. Further, the normalization was performed by heating at 960° C. for 60 seconds, then allowing the result to cool.

After this, the pipes were expanded to give a change of the outer circumference of 20% by plug insertion to obtain steel pipes of outside diameters of 232.4 mm. Some were aged for 2 hours by the temperatures shown in Table 2. Further, as the comparative materials for evaluating the change of the collapse pressure due to expansion, steel pipes having outside diameters of 232.4 mm were produced from the same hot rolled steel strips but not expanded. Some were aged at 2 hours at the temperature shown in Table 2.

The thus produced steel pipes were used for collapse tests and Charpy tests. The collapse tests were performed using pipes of lengths 10 times the pipe diameters as test samples under open end conditions where no stress occurred in the pipe axial direction. For the pressure medium, water was used and pressurized. The water pressure when the pressure dropped was used as the collapse pressure. The Charpy tests were conducted in accordance with JIS Z 2202 using V-notched test samples in a temperature range of −60° C. to room temperature.

The results are shown in Table 2. The effects of expansion and ageing on the collapse pressure were expressed by the ratios a/b and c/d with the collapse pressures of comparative materials produced without expansion. The Charpy absorbed energy aimed at was the 80J or higher at −20° C. believed to be sufficient for oil country tubular goods. Nos. 1 to 12 were in the range of examples of the present invention and had ratios a/b of the collapse pressure of 0.9 or higher. In particular, with ageing, c/d rose to 1.0 or more.

On the other hand, No. 13 had a coiling temperature higher than the range of the present invention and a low c/d. No. 14 had a c/d of more than 1.0, but the ageing temperature in this case was 350° C. This temperature is outside the present invention and cannot be realized in an oil well. Further, No. 15 had an amount of Nb smaller than the range of the present invention, so the c/d was low. Nos. 16 and 17 had Mn and C more than the ranges of the present invention, so their c/d's were low and their Charpy absorption energies fell.

TABLE 1

| Steel | Chemical composition (wt %) | | | | | | | | | | | | | | | | |
|---|---|---|---|---|---|---|---|---|---|---|---|---|---|---|---|---|---|
| no. | C | Si | Mn | P | S | Nb | Ti | Al | N | Ni | Mo | Cr | V | B | Ca | REM | Remarks |
| A | 0.08 | 0.24 | 1.86 | 0.016 | 0.002 | 0.052 | 0.015 | 0.032 | 0.0035 | — | — | — | — | — | — | — | Inv. |
| B | 0.06 | 0.36 | 0.76 | 0.012 | 0.003 | 0.034 | 0.012 | 0.045 | 0.0028 | — | 0.25 | — | 0.03 | — | 0.002 | — | ex. |
| C | 0.04 | 0.15 | 0.53 | 0.008 | 0.008 | 0.061 | 0.021 | 0.056 | 0.0042 | — | 0.12 | — | — | 0.0012 | — | — | |
| D | 0.22 | 0.41 | 0.95 | 0.023 | 0.001 | 0.039 | 0.013 | 0.018 | 0.0026 | 0.25 | — | — | — | — | — | 0.004 | |
| E | 0.15 | 0.25 | 1.28 | 0.015 | 0.004 | 0.044 | 0.017 | 0.052 | 0.0039 | — | — | 0.45 | — | — | — | — | |
| F | 0.12 | 0.26 | 1.34 | 0.013 | 0.002 | 0.003 | 0.016 | 0.061 | 0.0037 | — | — | — | — | — | — | — | Comp. |
| G | 0.07 | 0.17 | 3.1 | 0.014 | 0.002 | 0.049 | 0.014 | 0.033 | 0.0029 | — | 0.13 | — | — | — | — | — | ex. |
| H | 0.32 | 0.31 | 1.61 | 0.008 | 0.002 | 0.045 | 0.014 | 0.033 | 0.0036 | — | — | — | — | — | — | — | |

— in table indicate below limit of detection.
Underlines indicate outside scope of present invention.

TABLE 2

| Ex. | Steel | Coiling temperature | | Yield strength | Welded part heat | Ageing temperature | Collapse pressure MPa | | Charpy absorbed | Comparative material collapse pressure MPa | | | | |
|---|---|---|---|---|---|---|---|---|---|---|---|---|---|---|
| no. | no. | (° C.) | Structure* | (MPa) | treatment | (° C.) | a | c | energy J | b | d | a/b | c/d | Remarks |
| 1 | A | 200 | BF + B | 621 | None | None | 47 | — | 156 | 50 | — | 0.94 | — | Inv. |
| 2 | | | BF + B | | Quenching and tempering | 100 | — | 53 | 152 | — | 50 | — | 1.06 | ex. |

TABLE 2-continued

| Ex. no. | Steel no. | Coiling temperature (° C.) | Structure* | Yield strength (MPa) | Welded part heat treatment | Ageing temperature (° C.) | Collapse pressure MPa a | Collapse pressure MPa c | Charpy absorbed energy J | Comparative material collapse pressure MPa b | Comparative material collapse pressure MPa d | a/b | c/d | Remarks |
|---|---|---|---|---|---|---|---|---|---|---|---|---|---|---|
| 3 | | | BF + B | | None | 180 | — | 59 | 141 | | | — | 1.18 | |
| 4 | | 130 | BF + B | 646 | None | None | 48 | — | 148 | 52 | — | 0.92 | — | |
| 5 | B | 260 | BF + B | 633 | Normalization | None | 47 | — | 171 | 51 | — | 0.92 | — | |
| 6 | | | BF + B | | | 100 | — | 52 | 171 | — | 51 | — | 1.02 | |
| 7 | C | 230 | BF + B | 578 | None | None | 45 | — | 189 | 48 | — | 0.94 | — | |
| 8 | | | BF + B | | | 100 | — | 49 | 179 | — | 48 | — | 1.02 | |
| 9 | D | 220 | BF + B | 661 | Quenching and | None | 52 | — | 98 | 56 | — | 0.93 | — | |
| 10 | | | BF + B | | tempering | 100 | — | 56 | 89 | — | 56 | — | 1.00 | |
| 11 | E | 190 | BF + B | 702 | Normalization | None | 53 | — | 97 | 58 | — | 0.91 | — | |
| 12 | | | BF + B | | | 100 | — | 59 | 84 | — | 58 | — | 1.02 | |
| 13 | A | 510 | F + P | 583 | None | 100 | — | 34 | 145 | 48 | 48 | — | 0.71 | Comp. |
| 14 | | | F + P | | | 350 | — | 51 | 145 | | | — | 1.06 | ex. |
| 15 | F | 852 | BF + B | 643 | None | None | — | 33 | 121 | 52 | 52 | — | 0.63 | |
| 16 | G | 857 | BF + B | 913 | None | 100 | — | 50 | 56 | 61 | 61 | — | 0.82 | |
| 17 | H | 810 | BF + B | 955 | None | 100 | — | 42 | 32 | 65 | 65 | — | 0.65 | |

Underlines are conditions outside scope of present invention.

Ageing time = 2 hours

*BF: bainitic ferrite, B: bainite, M: martensite

Example 2

Steels having the chemical compositions shown in Table 1 were produced by a converter and continuously cast to steel slabs. The steel slabs were hot rolled by a continuous hot rolling machine. The obtained hot rolled steel strips were shaped into tubes and electric resistance welded at their seams to produce electric resistance welded steel pipes having outside diameters of 193.7 mm and thicknesses of 12.7 mm. These steel pipes were heat treated under the conditions shown in Table 3. Some of the steel pipes were tempered. The steel pipes not tempered are indicated by the "–" marks in the tempering column of Table 3.

The cooling rate in Table 3 was found by attaching a thermocouple to the center of thickness of the steel pipe then finding the rate from the change of temperature over time. That is, the cooling rate was found by dividing the temperature difference from 800° C. to 400° C., that is, 400° C., by the time required for cooling. The cooling stop temperature was the temperature shown in Table 3. Natural cooling was used for the temperature range below that. Note that the $Ac_3$ point shown in Table 3 is the measured value obtained by taking a small piece from a steel pipe, heating it, investigating its heat expansion behavior, and determining the change of the linear expansion rate.

After heat treatment, plugs were inserted and extracted to expand the pipes to give a 20% change of the outer circumference and obtain steel pipes of outside diameters of 232.4 mm. Some were aged for 2 hours by the temperatures shown in Table 3.

Further, as the comparative materials for evaluating the change of the collapse pressure due to expansion, electric resistance welded steel pipes having outside diameters of 232.4 mm were produced from the same steel strips and not expanded. Some were aged at 2 hours at the temperature shown in Table 3.

The thus produced steel pipes were used for collapse tests and Charpy tests in the same way as in Example 1. The effects of expansion and ageing on the collapse pressure were expressed by the ratios a/b and c/d with the collapse pressures of comparative materials produced without expansion. The Charpy absorbed energy aimed at was the 80J or higher at −20° C. believed to be sufficient for oil country tubular goods. Nos. 18 to 29 were in the range of examples of the present invention and had ratios a/b of the collapse pressure of at least 0.9. In particular, when aged, their c/d's rose to 1.0 or more.

On the other hand, No. 30 was tempered and had a low c/d. No. 31 had a c/d of more than 1.0, but the ageing temperature in this case was 350° C. This temperature is outside the present invention and not realizable in an oil well. No. 32 had a cooling rate faster than the range of the present invention and a microstructure of a mixture of martensite and bainite, was higher in strength, could not be expanded 20%, and fell in Charpy absorbed energy as well. Further, No. 33 had an amount of Nb smaller than the range of the present invention, so had a low c/d, while Nos. 34 and 35 had Mn and C more than the ranges of the present invention and therefore were low in c/d and fell in Charpy absorbed energy.

Note that the inventors investigated the a/b, c/d, and Charpy absorbed energy for seamless steel pipe comprised of the ingredients shown in Table 1 and produced under ordinary conditions and then heated, expanded, and aged as shown in Table 3. The results were substantially the same as in Table 3.

TABLE 3

| Ex. no. | Steel no. | $AC_3$ (° C.) | Heating temp. (° C.) | Cooling method | Cooling temp.* (° C./s) | Cooling stop temp. (° C.) | Tempering | Yield strength (MPa) | Microstructure** | Ageing temp. (° C.) | Collapse pressure MPa a | Collapse pressure MPa c | Charpy absorbed energy J | Comp. material collapse pressure MPa b | Comp. material collapse pressure MPa d | a/b | c/d | Remarks |
|---|---|---|---|---|---|---|---|---|---|---|---|---|---|---|---|---|---|---|
| 18 | A | 849 | 900 | Water cooling | 15 | 200 | — | 621 | BF + B | None | 47 | — | 126 | 52 | — | 0.90 | — | Inv. |
| 19 | | | | | | | | | | 100 | — | 55 | 122 | — | 52 | — | 1.06 | ex. |
| 20 | | | | | | | | | | 180 | — | 61 | 140 | | | — | 1.17 | |
| 21 | | | | | 25 | RT | — | 646 | BF + B | None | 49 | — | 151 | 53 | — | 0.92 | — | |
| 22 | B | 891 | 950 | Water cooling | 15 | 100 | — | 633 | BF + B | None | 46 | — | 168 | 50 | — | 0.92 | — | |
| 23 | | | | | | | | | | 100 | — | 52 | −161 | — | 50 | — | 1.04 | |
| 24 | C | 893 | 950 | Water cooling | 15 | 250 | — | 578 | BF + B | None | 44 | — | 148 | 47 | — | 0.94 | — | |
| 25 | | | | | | | | | | 100 | — | 48 | 137 | — | 47 | — | 1.02 | |
| 26 | D | 855 | 980 | Mist cooling | 5 | 350 | — | 661 | BF + B | None | 51 | — | 87 | 55 | — | 0.93 | — | |
| 27 | | | | | | | | | | 100 | — | 56 | 89 | — | 55 | — | 1.02 | |
| 28 | E | 852 | 930 | Water cooling | 15 | RT | — | 702 | BF + B | None | 52 | — | 96 | 57 | — | 0.91 | — | |
| 29 | | | | | | | | | | 100 | — | 58 | 86 | — | 57 | — | 1.02 | |
| 30 | A | 849 | 930 | Water cooling | 25 | RT | 600° C. −30 min | 583 | Tempering (BF + B) | 100 | — | 34 | 145 | — | 48 | — | 0.71 | Comp. |
| 31 | | | | | | | | | | 350 | — | 50 | 145 | | | — | 1.04 | ex. |
| 32 | E | 852 | 930 | Water cooling | 55 | RT | — | 932 | M+ B | None | — | — | 53 | — | 63 | — | — | |
| 33 | F | 857 | 930 | Water cooling | 15 | RT | — | 643 | BF + B | 100 | — | 34 | 121 | — | 53 | — | 0.64 | |
| 34 | G | 810 | 930 | Water cooling | 15 | RT | — | 913 | B | 100 | — | 52 | 56 | — | 63 | — | 0.83 | |
| 35 | H | 811 | 930 | Water cooling | 15 | RT | — | 955 | B | 100 | — | 44 | 32 | — | 64 | — | 0.69 | |

Underlines are conditions outside scope of present invention.
— not performed
*Average cooling in temperature range of 400 to 800° C. at center of thickness, ageing time = 2 hours
**BF: bainitic ferrite, B: bainite, M: martensite

INDUSTRIAL APPLICABILITY

According to the present invention, it is possible to provide oil country tubular goods excellent in collapse characteristics after expansion in an oil well pipe. In particular, since the collapse pressure is restored by low temperature ageing at 100° C. or so possible in an oil well, this is optimal as oil country tubular goods used in a well.

The invention claimed is:

1. Oil country tubular goods excellent in collapse characteristics after expansion consisting essentially of, by wt %:

C: 0.03 to 0.3%,
Si: 0.8% or less,
Mn: 0.3 to 2.5%,
P: 0.03% or less,
S: 0.01% or less,
Nb: 0.01 to 0.3%,
Ti: 0.005 to 0.03%,
Al: 0.1% or less, and
N: 0.001 to 0.01% and a balance of Fe and unavoidable impurities, characterized in that a ratio of collapse pressure after expansion and collapse pressure before expansion is in the range of a/b: 0.85 to less than 1.0, where a: collapse strength (MPa) after expansion 10 to 20% and b: collapse strength (MPa) of unexpanded steel pipe of same dimensions as steel pipe measured for a, said oil country tubular goods has a hot rolled structure having a low temperature transformation phase of only bainitic ferrite or bainite alone or combined.

2. Oil country tubular goods excellent in collapse characteristics after expansion consisting essentially of, by wt %:

C: 0.03 to 0.3%,
Si: 0.8% or less,
Mn: 0.3 to 2.5%,
P: 0.03% or less,
S: 0.01% or less,
Nb: 0.01 to 0.3%,
Ti: 0.005 to 0.03%,
Al: 0.1% or less, and
N: 0.001 to 0.01%, further containing one or more of:

Ni: 1% or less,
Mo: 0.6% or less,
Cr: 1% or less,
Cu: 1% or less,
V: 0.3% or less,
B: 0.0003 to 0.003%,
Ca: 0.01% or less, and
REM: 0.02% or less, and a balance of Fe and unavoidable impurities, characterized in that a ratio of collapse pressure after expansion and collapse pressure before expansion is in the range of a/b: 0.85 to less than 1.0, where a: collapse strength (MPa) after expansion 10 to 20% and b: collapse strength (MPa) of unexpanded steel pipe of same dimensions as steel pipe measured for a, said oil country tubular goods has a hot rolled structure having a low temperature transformation phase of only bainitic ferrite or bainite alone or combined.

3. Oil country tubular goods excellent in collapse characteristics after expansion consisting essentially of, by wt %:

C: 0.03 to 0.3%,
Si: 0.8% or less,
Mn: 0.3 to 2.5%,
P: 0.03% or less,
S: 0.01% or less,
Nb: 0.01 to 0.3%,
Ti: 0.005 to 0.03%,
Al: 0.1% or less, and
N: 0.001 to 0.01% and a balance of Fe and unavoidable impurities, characterized in that a ratio c/d of collapse pressure after expansion and ageing and collapse pressure before expansion is in the range of 1 to 1.2, where c: collapse strength (MPa) after expansion 10 to 20% and ageing at 80 to 200° C. and d: collapse strength (MPa) of unexpanded steel pipe of same dimensions as steel pipe measured for c, said oil country tubular goods has a hot rolled structure having a low temperature transformation phase of only bainitic ferrite or bainite alone or combined.

4. Oil country tubular goods excellent in collapse characteristics after expansion consisting essentially of, by wt %:

C: 0.03 to 0.3%,
Si: 0.8% or less,
Mn: 0.3 to 2.5%,
P: 0.03% or less,
S: 0.01% or less,
Nb: 0.01 to 0.3%,
Ti: 0.005 to 0.03%,
Al: 0.1% or less, and
N: 0.001 to 0.01%,
further containing one or more of:
Ni: 1% or less,
Mo: 0.6% or less,
Cr: 1% or less,
Cu: 1% or less,
V: 0.3% or less,
B: 0.0003 to 0.003%,
Ca: 0.01% or less, and
REM: 0.02% or less, and a balance of Fe and unavoidable impurities, characterized in that a ratio c/d of collapse pressure after expansion and ageing and collapse pressure before expansion is in the range of 1 to 1.2, where c: collapse strength (MPa) after expansion 10 to 20% and ageing at 80 to 200° C. and d: collapse strength (MPa) of unexpanded steel pipe of same dimensions as steel pipe measured for c, said oil country tubular goods has a hot rolled structure having a low temperature transformation phase of only bainitic ferrite or bainite alone or combined.

5. Oil country tubular goods excellent in collapse characteristics after expansion as set forth in claim 1 characterized by being used expanded in an oil well drilled into the ground.

6. Oil country tubular goods excellent in collapse characteristics after expansion as set forth in claim 1 characterized by being used expanded in an oil well drilled into the ground and with a fluid of 80 to 200° C. circulated through the well after expansion.

* * * * *